United States Patent [19]

Bos

[11] 3,982,782

[45] Sept. 28, 1976

[54] VACUUM LIFTING APPARATUS FOR CYLINDRICAL ARTICLES

[75] Inventor: Arie Bos, North Vancouver, Canada

[73] Assignee: MacMillan Bloedel Limited, Vancouver, Canada

[22] Filed: Apr. 21, 1975

[21] Appl. No.: 570,219

[52] U.S. Cl. ..... 294/64 R; 214/650 SG; 214/652

[51] Int. Cl.[2] ..... B66C 1/02; B66F 9/18

[58] Field of Search ..... 294/64 R, 65, 86 R, 294/87 R, 106; 214/650 R, 650 SG, 651, 652, DIG. 4, 653, 654; 269/21

[56] References Cited

UNITED STATES PATENTS

| | | | |
|---|---|---|---|
| 2,604,220 | 7/1952 | Frischmann | 214/652 |
| 2,683,546 | 7/1954 | Sherriff | 214/652 |
| 2,942,745 | 6/1960 | Horton | 294/64 R X |
| 3,147,872 | 9/1964 | Olson | 214/650 SG X |
| 3,219,379 | 11/1965 | Ames | 294/64 R |
| 3,227,299 | 1/1966 | Draxler | 294/64 R X |
| 3,260,392 | 7/1966 | Harris | 294/65 X |
| 3,276,611 | 10/1966 | Horton | 214/650 SG |
| 3,376,061 | 4/1968 | Harris et al. | 294/64 R |
| 3,627,369 | 12/1971 | Nixon | 294/64 R |
| 3,696,596 | 10/1972 | Wegscheid | 294/64 R X |

*Primary Examiner*—Johnny D. Cherry
*Attorney, Agent, or Firm*—Fetherstonhaugh & Co.

[57] ABSTRACT

Lifting apparatus including two pairs of opposed backing plates of curved cross section mounted for horizontal swinging movement, each plate being mounted for horizontal and vertical swinging movement. Each backing plate has a resilient seal secured thereto in the form of a continuous pneumatic tube which projects outwardly from the plate to form a cushion and a seal, and is arranged with side sections and end sections forming a suction space. When each pair of plates is moved against a cylindrical article, suction is applied to the suction space bounded by the pneumatic tube to draw the article against the latter. This also draws the article against vertical friction plates on each backing plate and located adjacent side sections of the pneumatic tube thereof.

16 Claims, 16 Drawing Figures

Figure 1:
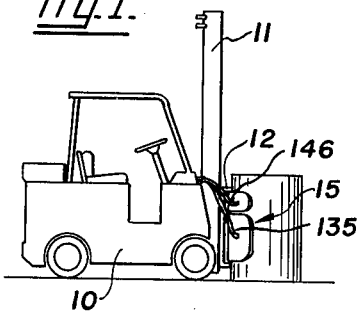

Fig. 7.
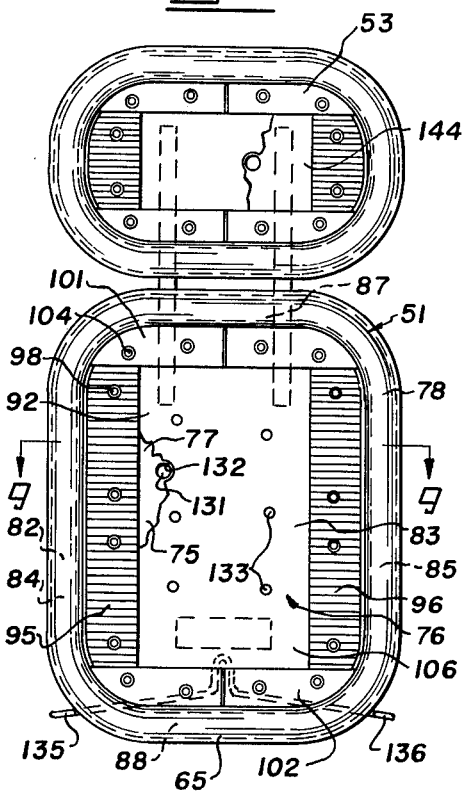
Fig. 8.
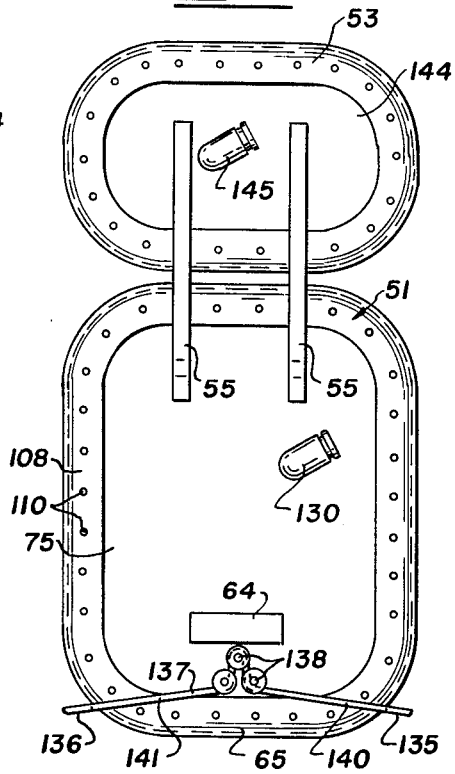
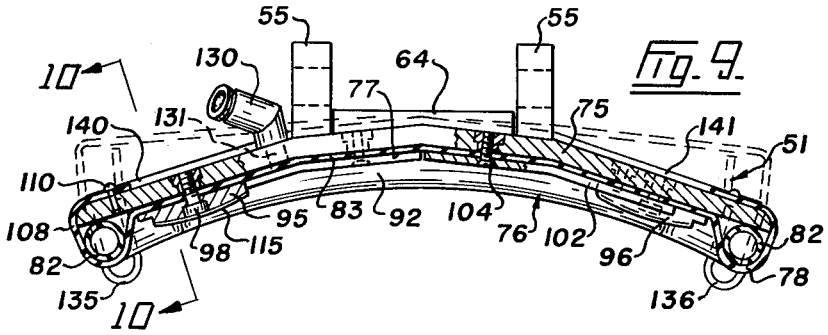
Fig. 9.
Fig. 10.
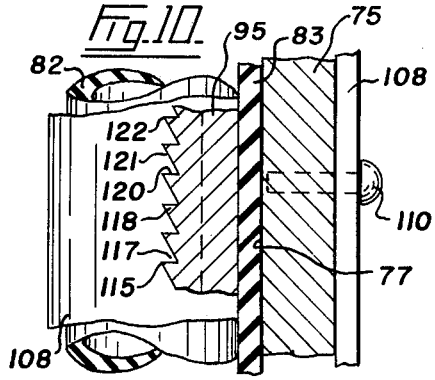

VACUUM LIFTING APPARATUS FOR CYLINDRICAL ARTICLES

This invention relates to vacuum lifting apparatus for heavy cylindrical articles such as rolls of newsprint paper or kraft paper, wrapped or not wrapped, one or several rolls in one wrapper, in good as well as in damaged condition, these rolls being gripped at the cylindrical surfaces thereof. For the sake of convenience, this apparatus is described herein in connection with rolls of newsprint paper.

There are many suction pick-up devices in the prior art, but most of these do not appear to have been very successful when applied to a wide range of diameters. Mechanical clamping devices are still most widely used despite the fact that they have distinct disadvantages in their inability to handle rolls in tightly placed situations and often damage the rolls.

A typical suction pick-up device in common use is mounted on the forward portion of a lift truck so that it can be raised and lowered by the hydraulic system of the truck. It includes a large suction cup which is pushed against the side of the roll of paper and then vacuum is applied to suck the roll against the cup so that the roll can be lifted for transportation. However, the sealing means of the vacuum cup is such that it will not easily comply with a large range of roll diameters, limiting its usefulness. The poorer compliance of the sealing component also increases the level of skill required by the operater thereby adding to the difficulty of having well trained operators available for ship loading or discharge operations.

The vacuum lifting apparatus of the present invention is designed to eliminate or greatly reduce these problems. This apparatus can pick up two rolls, but it also can pick up or drop one roll at a time. Obviously, the apparatus could be constructed to handle only one roll at a time.

In the preferred form, the present apparatus includes at least two pairs of suction pads or cups. Each pad can swing horizontally and vertically, each pair of pads can swing as a unit horizontally, and the carrier on which the four pads are mounted can swing horizontally. These self-aligning features and the design features of the seals used with these pads reduce the accuracy and skill required by the driver of the lift truck in order to pick up one or two rolls.

Each suction pad includes a rigid backing plate and a pneumatic seal which, combined with the self-aligning feature of the pad, make it possible to pick up rolls of a diameter range of from about 30 to 50 inches, or other equivalent ranges, which is a much larger range than is possible with existing designs. Specially designed friction plates within an annular seal of each suction pad form an important feature of this invention.

Another important feature of this vacuum lifting apparatus is that when two rolls are lifted, they are swung and wedged together so that they do not swing apart when the vehicle turns corners. This increases safety of operation and keeps rolls close together for neat placement at destination.

The present apparatus is very easy to maintain, and a suction pad can be replaced in a few minutes. The entire lifting apparatus is designed as compact as possible to maintain best visibility for the driver so that he can see the rolls clearly when he approaches them for pick up, at any height or when he is trying to place rolls at their destination.

Vacuum lifting apparatus in accordance with this invention comprises a support, and at least one backing plate mounted on said support for limited swinging movement. This plate has in cross section an inner surface in a generally shallow curve from one edge to an opposite edge in order to extend around the curved surface of a cylindrical roll. A seal is provided on the inner surface of the backing plate, and this includes a continuous pneumatic tube. The seal also includes means for retaining the pneumatic tube in position. This means is anchoring sheet of flexible material which extends over the backing plate and beyond the edge and all around the perimeter thereof. The tube can be behind or over the sheet, ot ir may or may not be secured thereto, or it may be molded with the sheet. The face of the seal is forced outwardly from the inner surface of the backing plate by air pressure to form a cushion for the cylindrical article to provide a seal against said article, and it forms a suction space within the bounds of the sealing tube. Aperture means is provided in the backing plate and the anchor sheet through which suction can be applied to the suction space. With this arrangement, when the backing plate is moved to press the seal against the cylindrical article, the suction retains the article against the seal and brings it in firm contact in with friction plates. The swing movement of the backing plate ensures contact of the entire pneumatic seal with the cylindrical article, and this seal ensures good sealing contact with articles of different diameters.

If the apparatus is to be used for lifting cylindrical rolls of many different heights, it may have a second backing plate above the first backing plate and having the same seal arrangement as the latter.

Figure 2:
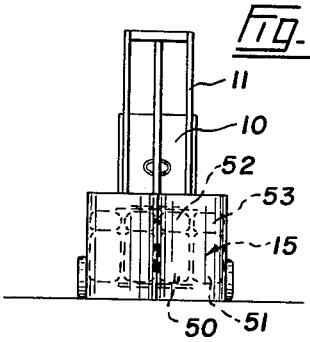
Figure 3:
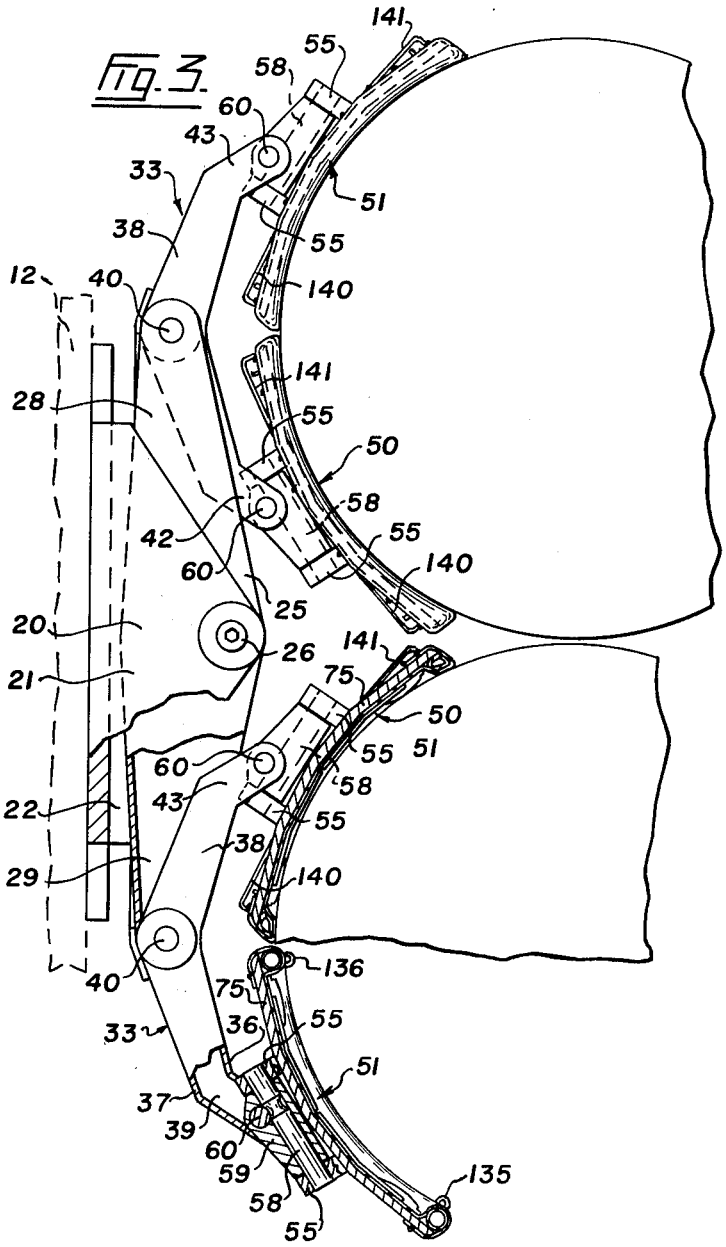
Figure 6:
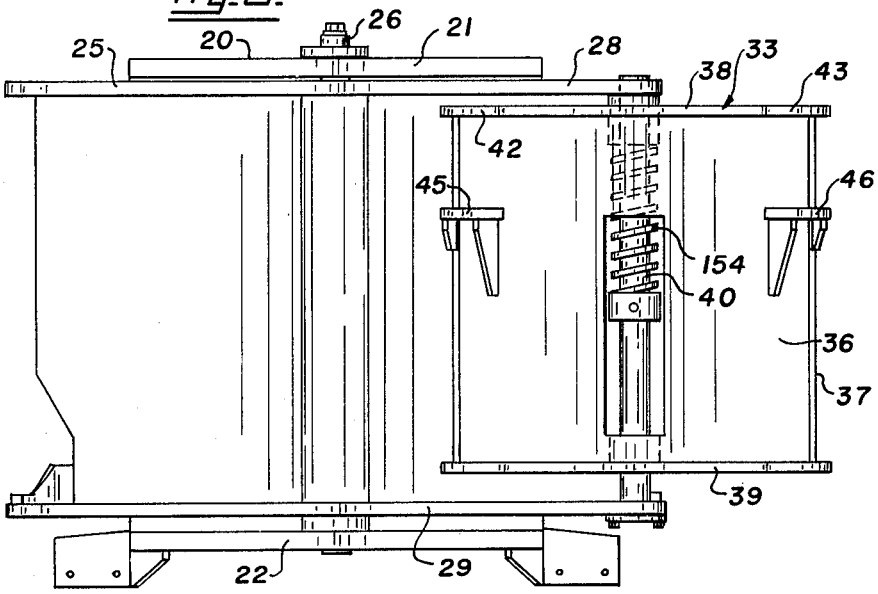
Figure 4:
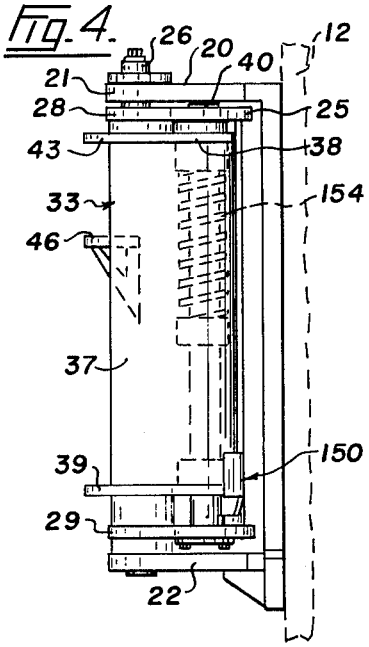
Figure 5:
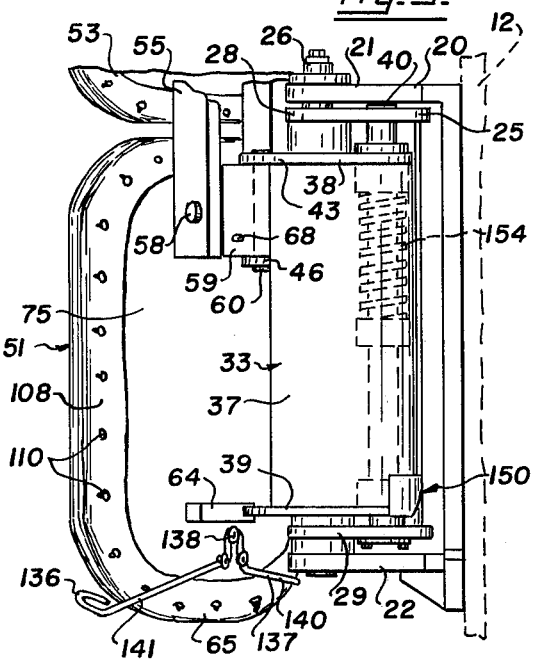
Figure 11:
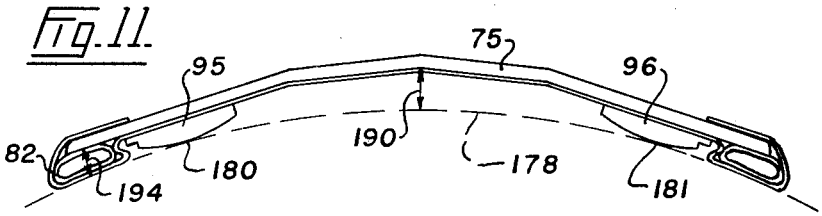
Figure 12:
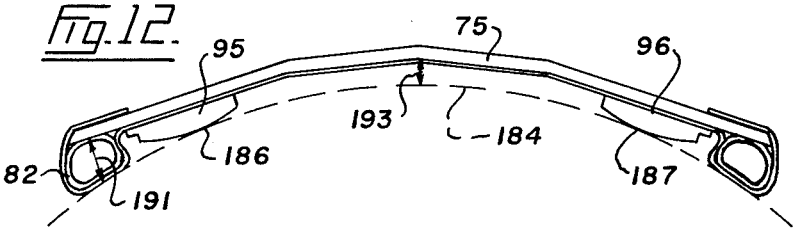
Figure 13:
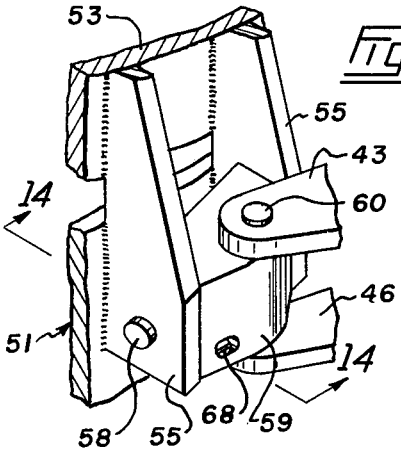
Figure 14:
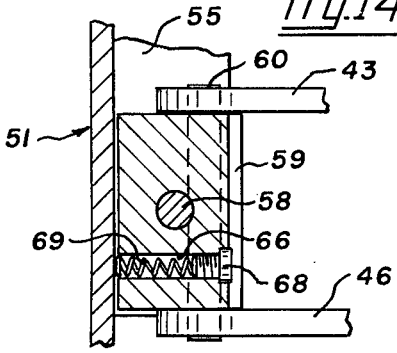
Figure 15:
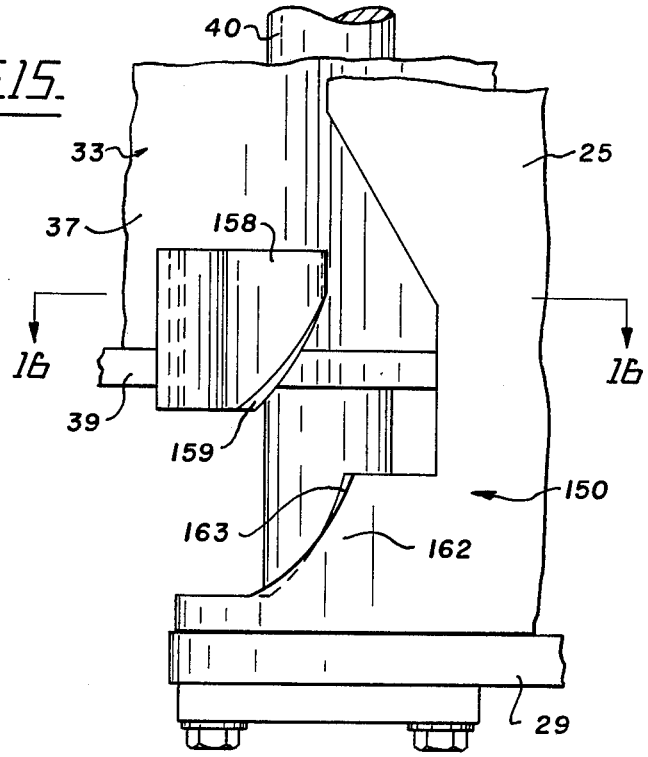
Figure 16:
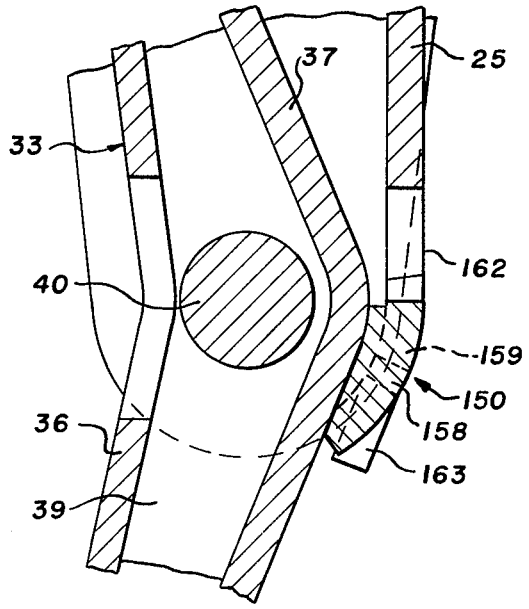

A preferred form of vacuum lifting apparatus in accordance with this invention is illustrated in the accompanying drawings, in which FIG. 1 is reduced diagrammatic side elevation of a lift truck with the vacuum apparatus mounted thereon, FIG. 2 is a diagrammatic front elevation of the apparatus of FIG. 1, FIG. 3 is an enlarged plan view of the vacuum lifting apparatus, FIG. 4 is a side elevation of the apparatus, but with the near suction pad removed, FIG. 5 is another side elevation of the lifting apparatus, showing the back of a suction pad, FIG. 6 is a front elevation of the lifting apparatus with its left hand pair of suction pads and their support removed, and the right hand pair of suction pads removed but showing the support thereof, FIG. 7 is an enlarged front elevation of a suction pad arrangement including lower and upper suction pads, FIG. 8 is a back view of the pad arrangement of FIG. 7, FIG. 9 is an enlarged horizontal section taken on the line 9—9 of FIG. 7, FIG. 10 is an enlarged fragmentary vertical section taken on the line 10—10 of FIG. 9, FIGS. 11 and 12 are diagrammatic horizontal sections through a suction pad illustrating the contacts with the seals thereof made with two rolls of different diameters, FIG. 13 is an enlarged fragmentary perspective view of the pivotal mounting arrangement of a suction pad, FIG. 14 is a fragmentary section on line 14—14 of FIG. 13, FIG. 15 is an enlarged elevation of the cam arrangement for a suction pad support, and FIG. 16 is a fragmentary horizontal section taken on the line 16—16 of FIG. 15.

Referring to FIGS. 1 and 2 of the drawings, 10 is a standard lift truck having the usual vertical tower 11 at its front upon which a carriage 12 is mounted for vertical movement. The lift truck has the usual hydraulic system for raising and lowering the carriage. Vacuum lifting apparatus 15 in accordance with this invention is mounted on carriage 12 so as to be raised and lowered thereby. This apparatus is designed to lift one or two heavy cylindrical articles, such as rolls of newsprint paper, for transportation.

The vacuum lifting apparatus 15 includes a bracket 20 fixedly secured to carriage 12, and having upper and lower lugs 21 and 22 projecting outwardly therefrom. A carrier 25 is swingably connected to bracket 20 by a vertical pin or shaft 26 which has its end supported in lugs 21 and 22. Carrier 25 includes upper and lower yokes 28 and 29 projecting forwardly therefrom through which pin or shaft 26 extends.

A pair of symmetrical supports 33 are mounted on and between the upper and lower yokes 28 and 29 of carrier 25 at ends thereof, see FIG. 3. As supports 33 and the elements associated with them are substantially identical with each other, only one will now be referred to for the sake of convenience.

The support 33 includes forwardly curved and spaced vertical front and rear walls 36 and 37 joined together by upper and lower arms 38 and 39. Arms 38 and 39 are journalled to the adjacent ends of the carrier yokes 28 and 29 by a vertical pin or shaft 40. Lugs 42 and 43 project outwardly from opposite ends of upper support arm 38, another pair of lugs 45 and 46 are mounted on front wall 36 spaced below and in line with upper lugs 42 and 43 respectively.

A pair of identical suction pads 50 and 51 are mounted on the outer ends of the arms of each support 33. If desired, another pair of identical upper pads 52 and 53 may be mounted above the lower pads 50 and 51, respectively. Pads 52 and 53 are the same as pads 50 and 51 excepting that they are shorter in the vertical direction. As these suction pads are basically identical, only one will now be described in detail, namely pad 51.

Pad 51 has a pair of spaced lugs 55 projecting from its outer or back surface near the upper edge of the pad as shown in FIG. 8. A horizontal pin 58 journals a block 59 to lugs 55 for vertical swinging movement, see FIGS. 3, 4 and 13, said block being journalled by vertical pin 60 to support lugs 43 and 46 of support 33 for horizontal swinging movement. With this arrangement, the suction pad 51 can swing both vertically and horizontally. A stop 64 on the back of pad 51 is aligned with lower arm 39 of support 33 to limit the inward movement of the lower portion of the suction pad.

Suitable means is provided for resiliently urging the lower edge 65 of pad 51 forwardly or outwardly relative to its support 33, FIGS. 13 and 14 illustrate one way of accomplishing this. Block 59 has a bore 66 therethrough below pin 58 and extending at right angles thereto. a spring 69 is connected at one end to plug 68 which is threaded in the outer end of bore 66, the opposite end of said spring projecting from the inner end of the bore and bearing against the back of pad 51.

This spring applies sufficient pressure to urge the lower end of the pad outwardly.

The details of the construction of suction pad 51 are illustrated in FIGS. 7 to 10. This pad is made up of a backing plate 75 having a shallow generally curved cross section, see FIG. 9. A sealing arrangement 76 is located on the inner surface 77 of plate 75, and includes an annular seal 78 of generally rectangular configuration mounted on said inner surface. This seal preferably includes a continuous pneumatic tube 82 which projects outwardly from the backing plate. The seal also includes an anchoring sheet 83 of suitable flexible material, such as rubber, plastics or the like. This sheet retains the pneumatic tube in proper position on the backing plate. Tube 82 has vertical side sections 84 and 85 extending along plate 75 near the side edges thereof, and spaced-apart horizontal end sections 87 and 88 extending between and connected to adjacent ends of the side sections. Tube 82 projects outwardly from the inner surface of backing plate 75 and forms a suction space 92 enclosed by said tube.

Spaced vertical and rigid friction strips 95 and 96 are placed over anchoring sheet 83 within suction space 92 and are secured to backing plate 75 by a plurality of socket screws 98. Upper and lower securing strips 101 and 102 are placed over this sheet within the suction space and are secured to the backing plate by a plurality of socket screws 104. These friction strips and securing strips retain anchor sheet 83 in position on backing plate 75, and the central portion 106 of the sheet lies loosely against the backing plate. It will be noted that the outer edges of strips 95, 96, 101 and 102 are shaped so that they fit within tube 82. In this form of the invention, tube 82 is inflated and is fitted around these friction and securing strips. The edge portion 108 of sheet 83 overlies tube 82 and is drawn around the adjacent edges of backing plate 75 amd fitted onto studs 110 projecting from the outer or back surface of the plate. It will be noted that the edge portion of the sheet is drawn over the entire edge of the backing plate all the way around tube 82.

As friction plates 95 and 96 are identical, only one, namely plate 95, will now be described in detail.

Friction plate 95 has an outer surface 115 which is convex in cross section, as clearly shown in FIGS. 9, 11 and 12. This convex surface has a plurality of horizontal grooves 117 therein forming horizontal teeth 118, see FIG. 10. Each tooth 118 is preferably formed with an upwardly facing flat surface 120 and a downwardly inclined lower surface 121 forming therebetween an edge 122. The cross sectional shape of these teeth is such that they will resist downward movement of an object being held against the outer surface 115.

In the construction just described, tube 82 is free of anchor sheet 83 but is held in place by the latter. On the other hand, the tube can be adhesively secured to the anchor sheet, or the anchor sheet can be molded with the tube incorporated therein and forming a part thereof.

A pipe elbow 130 communicates with an oriface 131 through backing plate 75 which in turn is substantially aligned with a hole 132 in the central portion 106 of sheet 83 and opening into suction space 92. This central portion of the sheet is provided with a plurality of relatively small holes 133 therein.

The elbow 130 is connected to a flexible nose 135, see FIG. 1, which extends to a suction pump, not shown, mounted on lift truck 10.

As stated above, the lower edge 65 of suction pad 51 is resiliently urged forwardly by spring 66 in block 59. It is desirable to provide feelers projecting forwardly from this lower edge to engage the surfaces of rolls to be picked up to align the suction pads with these surfaces. In this example, a pair of feelers or fingers 135 and 136 are located at opposite ends of the lower edge 65 and project forwardly from the pad, see FIGS. 5 and 7 to 9. These fingers are resiliently biased into their forward position. In this example, fingers 135 and 136 are formed on the ends of a piece of wire 137 which is bent in behind the lower portion of backing plate 75 and is secured midway between its ends to the plate by screws 138. Actually, wire 137 which is secured at its mid point to the backing plate has laterally-extending arms 140 and 141 which are free of and extend along the back surface of plate 75 and beyond the ends of lower edge 65 of said plate. Fingers 135 and 136 are formed on the free ends of arms 140 and 141 so that when suction pad 51 is moved towards a roll, fingers 135 and 136 engage the transversely curved surface of the roll at two spaced-apart points to align the suction pad properly with the roll. Continued forward movement of the suction pad causes fingers 135 and 136 to be depressed until the lower portion of seal 78 engages the roll surface, following which the lower edge of the suction pad swings rearwardly until the entire seal engages the roll surface.

Suction pads 51 can be used alone, but it is preferable to provide an upper suction pad 53 above each pad 51. The upper pad and its sealing arrangement are the same as pad 51 and its sealing arrangement 76, with the exception that pad 53 is not as long vertically as pad 51. By referring to FIG. 8 it will be seen that lugs 55 are relatively long and project upwardly above the upper edge of backing plate 75. These lugs are secured to the back of backing plate 144 of pad 53. These lugs are made large and strong enough to act as strongbacks rigidly securing the backing plates 75 and 144 together.

The lower suction pad is used along for relatively short rolls, while the upper pad 53 is brought into play along with the lower pad for longer or higher rolls. The upper suction pad has it own elbow 145 which is connected by a hose 146, see FIG. 1, to the suction source on the lift truck. The suction of the upper pad is controlled independently of that of the lower pad so that either suction pad can be used alone or they can be used at the same time.

Summing up, the vacuum lifting apparatus 15 is made up of two pairs of lower suction pads 50 and 51, and two pairs of upper suction pads 52 and 53 fixedly secured to pads 50 and 51, respectively. The pads 50, 52 and 51, 53 form two sets of suction pads. Each set of pads is mounted so that it can swing to a limited degree both vertically and horizontally independently of the other set of pads. The suction pads of each pair are mounted side by side on a support 33 which is mounted for limited horizontal swinging action. The two supports 33 are mounted on carrier 25 which, in turn, is mounted on lugs 21 and 22 of bracket 20 for limited horizontal swinging action. Bracket 20 is mounted on carriage 12 of lift truck 10 so that apparatus 15 can be raised and lowered by the hydraulic system of the lift truck.

It is desirable to prevent rolls that are being transported by apparatus 15 from swinging away from each other when being conveyed around a corner, and to hold said rolls together. For this purpose each pair of suction pads 50, 51 is provided with a cam arrangement 150, shown in FIGS. 15 and 16.

First of all the support 33 is mounted for vertical movement on shaft 40, and is biased upwardly by a spring 154 against the upper yoke 28 of carrier 25.

The rear wall 37 of support 33 has a cam 158 mounted thereon near its lower edge and located outwardly a little in a lateral direction relative to shaft 40, see FIG. 16. This cam has a curved cam surface 159 facing generally downwardly as shown in FIG. 15. Carrier 25 is provided with a complementary cam 162 near its lower yoke 29, said cam having a curved cam surface 163 facing generally upwardly. The cam surface 159 is normally above cam surface 163, and these surfaces are aligned. The curves of cam surfaces 159 and 163 are such that when support 33 is moved downwardly these surfaces engage and cause support 33 to swing inwardly, that is, generally towards the central vertical shaft 26.

When carrier 25 is raised by carriage 12 while two rolls are being gripped by the pairs of suction pads, the weight of the rolls pulls supports 33 downwardly against the action of springs 154 causing the cams 158 to engage cams 162. The action of the two cams causes supports 33 to swing inwardly until the two rolls come into engagement. The cams cause the rolls to be pressed together so that they do not swing freely during transport and are in close contact when placed at destination.

FIGS. 11 and 12 illustrate the purpose of the transversely curved outer surfaces 115 of friction plates 95 and 96. The line 178 in FIG. 11 represents the peripheral curve of a roll of relative large diameter. This surface contacts the surfaces of friction plates 95 and 96 in the areas 180 and 181. The line 184 in FIG. 12 represents the curved peripheral surface of a roll of relatively small diameter. The surface of this roll contacts the friction plate surfaces in the areas 186 and 187. Thus, in both cases, the roll surfaces contact gently curved surfaces of the friction plates. This prevents either of the roll surfaces from coming into contact with vertical corners of the friction plates. As a large portion of the lift applied to the rolls is provided through the areas of contact of the friction plates with the roll surfaces, it is important that no sharp edges, and particularly vertical edges, of any length come into contact with the roll surfaces.

The curvature of backing plate 75 and the convexity and thickness of friction plates 95 and 96 are selected to use the range of compressibility of the seal tube 82 to best advantage, that is, to accommodate the largest range of roll diameters. The seal tube must be depressed to a certain degree to make a good seal, and should not be depressed beyond a predetermined point. In other words, there is a range of depressibility in which the seal tube is most effective. The backing plate curvature and the corss sectional curvature of the friction plates are such as to accommodate with effective sealing as many different roll diameters as possible.

Assuming that lines 178 and 184 represent rolls of the largest and smallest diameters, respectively, the general curve of plate 75 and the transverse curves and the thickness of friction plates 95 and 96 are arranged in the following manner. The distance 190 between maximum diameter line 178 and the backing plate at the center of the latter in FIG. 11 is substantially the same as the distance 191 between the minimum diameter line 184 and the backing plate at sealing tube 82 in FIG. 12. Similarly, the distance 193 between minimum diameter line 184 and the center of the backing plate in FIG. 12 is substantially the same as the distance 194 between the maximum diameter line 178 and the backing plate at the sealing tube in FIG. 11.

The operation of lifting apparatus 15 is quite simple. When the operator of lift truck 10 wants to pick up a pair of rolls, he moves the truck towards the rolls with carriage 12 at a height corresponding with that of the rolls to be picked up. The feeler fingers 135 and 136 at the lower edges of suction pads 50 and 51 first come into contact with the rolls. These fingers properly align the suction pads with the roll surface, and further movement of the truck causes the pads to swing around their horizontal axis until the seals of the pads are pressed against the roll surfaces, as shown in FIG. 3. The suction pads 52 and 53, if present, are moved against the roll surfaces at the same time. The pivotal mountings of carrier 25, supports 33 and the suction pads enable the latter to readily adjust to rolls of different diameters and to compensate for any errors in alignment of the truck with the rolls when driven up to these rolls. As the seals 78 project forwardly from their respective backing plates 75, see FIG. 9, they first come into contact with the surface of each roll and are compressed until the seal contacts the roll along the entire length of the seal. As these seals are tubes, they compress readily, and yet will fit into any depression in the roll surface. The pneumatic tubes are superior to the resilient elements used for sealing purposes in the prior art. The latter do not have the compressibility and the surface fitting properties of the pneumatic tubes. At this time, the operator causes suction to be applied to the suction spaces 92 within the pneumatic seals of the suction pads. Alternatively, detector or sensor means may be provided at each suction pad to automatically apply the suction when the roll surface moves into complete contact with the seals surrounding the suction spaces thereof. The fact that the pads are hingedly suspended about two axes results in an even application of the sealing tubes to the roll surface. The lower section of each tube engages the roll first and then the suction pad swings vertically until the side sections and upper section of the tube come into contact with the roll surface. This results in the pneumatic seal being aligned prior to making firm contact instead of just being pushed against the roll which produces seal wear and might result in the tube not being properly placed against the surface.

Once the suction has been applied, and the vacuum forces draw the roll against friction plates 95 and 96, carriage 12 can be raised to lift the roll upwardly. The swinging action of carrier 25 and of the two supports 33 enable the pairs of pads to be properly placed against their respective rolls. When the two rolls are gripped, carriage 12 is elevated to lift them off the ground, after which they may be transported to any desired location. After carriage 12 is lowered to deposit the rolls the suction is cut off, and both rolls are free. If it is desired to lift or discharge one roll only, the vacuum is applied or removed selectively by means of the operator's controls.

When carriage 12 is raised with rolls gripped by apparatus 15, the weight of each roll overcomes the upward force of spring 154 and cam arrangement 150 of each support 33 carrying a roll is brought into action to shift the rolls against each other. This prevents the rolls from swinging during transportation, particularly when the lift truck makes a turn, and keeps rolls in close contact for neat placement at destination.

I claim:

1. Vacuum lifting apparatus for generally cylindrical articles, comprising:

a support, a rigid backing plate mounted on said support for limited swinging movement, said plate having an inner surface in cross section in a generally shallow curve from one edge to an opposite edge of the plate in order to extend over the curved surface of a cylindrical article, a seal on the inner surface of the backing plate in the form of a continuous pneumatic tube with side sections extending along the plate near said opposite edges and spaced apart end sections extending between adjacent ends of said side sections, said seal projecting outwardly from the inner surface of the backing plate to form a cushion for a cylindrical article and a seal against said article and forming a suction space over said inner surface, means for retaining the seal on the backing plate, means at the backing plate through which suction can be applied to said suction space, and a pair of spaced-apart vertical friction plates mounted on the backing plate and each located near a side section of the pneumatic tube, each of said friction plates having a horizontally convexed outer surface to be engaged by the surface of a cylindrical article bearing against said tube, whereby when the backing plate is moved to press the seal against the cylindrical article said suction retains the article against the friction plates and the seal, said swinging movement of the plate ensuring contact of the entire pneumatic tube and the friction plates with the cylindrical article and said tube ensuring good sealing contact with articles of different diameters.

2. Vacuum lifting apparatus as claimed in claim 1 in which said backing plate is mounted for both horizontal and vertical swinging movement.

3. Vacuum lifting apparatus as claimed in claim 2 including means causing the lower edge of the backing plate to project outwardly from said support more than the upper edge of the plate when said lower edge is free.

4. Vacuum lifting apparatus as claimed in claim 3 including feelers supported by the backing plate near the lower edge thereof, and biasing means connected to said feelers resiliently urging said feelers outwardly from the backing plate.

5. Vacuum lifting apparatus as claimed in claim 1 in which the outer surface of each of said friction plates is formed with horizontal grooves therein forming transverse teeth projecting outwardly relative to the backing plate.

6. Vacuum lifting apparatus as claimed in claim 1 including a second backing plate above and rigidly secured to the first-mentioned backing plate, a second continuous pneumatic tube on the inner surface of the second backing plate similar to the first-mentioned pneumatic tube and forming a suction space over the latter inner surface, means for retaining the second tube on the second plate, means at said second backing plate through which suction can be applied to the suction spaced formed by the second tube, and a pair of spaced-apart vertical friction plates mounted on said second backing plate and each located near a side section of the second pneumatic tube, each of the latter friction plates having a horizontally convexed outer surface to be engaged by the cylindrical surface of said article bearing against the second tube.

7. Vacuum lifting apparatus as claimed in claim 1 in which said means for retaining the seal on the backing plate comprises a flexible anchor sheet overlying the inner surface of the backing plate and having an edge portion folded over and around the edge of the backing plate and fitting onto studs projecting from the outer surface of said plate near the edge of the latter, said edge portion engaging the pneumatic tube to retain said tube on the backing plate.

8. Vacuum lifting apparatus as claimed in claim 7 including means securing the anchor sheet to the backing plate within the area bounded by the pneumatic tube.

9. Vacuum lifting apparatus as claimed in claim 8 in which said edge portion of the anchor sheet engages the pneumatic tube by overlying said tube.

10. Vacuum lifting apparatus comprising:

a support, a pair of rigid backing plates mounted side by side on said support for limited swinging movement towards and away from each other, each of said plates having in cross section an inner surface in a generally shallow curve from one edge to an opposite edge of the plate in order to extend over the curved surface of a cylindrical article, a seal on the inner surface of each backing plate in the form of a continuous pneumatic tube with side sections extending along the plate near said opposite edges and spaced apart end sections extending between adjacent ends of said side sections, said seal projecting outwardly from the inner surface of the backing plate to form a cushion for a cylindrical article and a seal against said article and forming a suction space over said inner surface, means for retaining each seal on the backing plate thereof, aperture means at each backing plate through which suction can be applied to the suction space of said each plate, and a pair of spaced-apart vertical friction plates on each backing plate and each located near a side of said pneumatic tube thereof, each of said friction plates having a horizontally convexed outer surface to be engaged by the surface of a cylindrical article bearing against said tubes, whereby when the support is moved to move said backing plates to press the seals thereof against the cylindrical article said suction retains the article against said friction plates and said seals, said swinging movement of the plates ensuring complete contact of both of said pneumatic tubes and said friction plates with the cylindrical article and said tubes ensuring good sealing contact with articles of different diameters.

11. Vacuum lifting apparatus as claimed in claim 10 in which each of said backing plates is mounted for both horizontal and vertical swinging movement.

12. Vacuum lifting apparatus as claimed in claim 10 in which the outer surface of each of said friction plates is formed with horizontal grooves therein forming transverse teeth projecting outwardly relative to the respective backing plate.

13. Vacuum lifting apparatus as claimed in claim 10 including a second backing plate above and rigidily secured to each of the first-mentioned backing plates, a second continuous pneumatic tube on the inner surface of each second backing plate similar to the first-mentioned pneumatic tube and forming a suction space over the latter inner surface, means for retaining the second tube on the second backing plate, means at said second backing plate through which suction can be applied to the suction space formed by the second tube, and a pair of spaced-apart vertical friction plates mounted on said second backing plate and each located near a side section of the second pneumatic tube, each of the latter friction plates having a horizontally convexed outer surface to be engaged by the cylindrical surface of said article bearing against the second tube.

14. Vacuum lifting apparatus comprising:

a carrier adapted to be mounted on a vertically movable carriage of a lift vehicle and having side edges, a pair of supports, means mounting each support on the carrier near a side edge thereof for horizontal swinging movement, a pair of backing plates for each support and positioned side by side, pivot means mounting each backing plate on the support thereof for limited horizontal swinging movement, a seal on each backing plate to form a cushion for a cylindrical article and a seal against said article enclosing a suction space, means to permit suction to be applied to said suction space, a cam arrangement for each support and having cooperating cam members, and means normally urging each support upwardly to separate the cam members thereof, the cam arrangements of each support being mounted so that when a cylindrical article is being supported by the backing plates thereof, the cam members of said support come together and swing said each support towards the other of said supports, whereby cylindrical articles supported by said backing plates are swung towards each other.

15. Vacuum lifting apparatus comprising;

a carrier adapted to be mounted on a vertically movable carriage of a lift vehicle and having side edges, a pair of supports, means mounting each support on the carrier near a side edge thereof for horizontal swinging movement, a pair of backing plates for each support and positioned side by side, pivot means mounting each backing plate on the support thereof for limited horizontal swinging movement, second pivot means mounting each backing plate for limited vertical swinging movement, means biasing the lower edge of each backing plate outwardly farther from the respective backing plate than the upper edge of said backing plate, a seal on each backing plate to form a cushion for a cylindrical article and a seal against said article enclosing a suction space, means to permit suction to be applied to said suction space, a cam arrangement for each support and having cooperating cam members, and means normally urging each support upwardly to separate the cam members thereof, the cam arrangements of each support being mounted so that when a cylindrical article is being supported by the backing plates thereof, the cam members of said support come together and swing said each support towards the other of said supports, whereby cylindrical articles supported by said backing plates are swung towards each other.

16. Vacuum lifting apparatus as claimed in claim 15 including feelers supported by each backing plate near the lower edge thereof, and biasing means connected to said feelers resiliently urging said feelers outwardly from their respective backing plates.

* * * * *